US008034760B2

(12) United States Patent
Ozeki et al.

(10) Patent No.: US 8,034,760 B2
(45) Date of Patent: Oct. 11, 2011

(54) SOFTENING DETERGENT COMPOSITION

(75) Inventors: Yohei Ozeki, Wakayama (JP); Teruo Kubota, Wakayama (JP); Motomitsu Hasumi, Wakayama (JP)

(73) Assignee: Kao Corporation, Tokyo (JP)

( * ) Notice: Subject to any disclaimer, the term of this patent is extended or adjusted under 35 U.S.C. 154(b) by 457 days.

(21) Appl. No.: 11/989,780

(22) PCT Filed: Jul. 31, 2006

(86) PCT No.: PCT/JP2006/315100

§ 371 (c)(1),
(2), (4) Date: Jan. 31, 2008

(87) PCT Pub. No.: WO2007/015440

PCT Pub. Date: Feb. 8, 2007

(65) Prior Publication Data

US 2010/0093593 A1 Apr. 15, 2010

(30) Foreign Application Priority Data

Aug. 1, 2005 (JP) ..... 2005-223513

(51) Int. Cl.
*C11D 1/83* (2006.01)

(52) U.S. Cl. ..... 510/507

(58) Field of Classification Search ..... 510/507
See application file for complete search history.

(56) References Cited

U.S. PATENT DOCUMENTS

| | | | | |
|---|---|---|---|---|
| 4,062,647 | A | 12/1977 | Storm et al. | |
| 4,609,473 | A | 9/1986 | Ramachandran et al. | |
| 5,126,060 | A | 6/1992 | Puentes-Bravo et al. | |
| 5,183,505 | A * | 2/1993 | Spinney | 106/672 |
| 5,290,459 | A | 3/1994 | Puentes-Bravo et al. | |
| 5,332,513 | A | 7/1994 | Doms et al. | |
| 5,358,647 | A | 10/1994 | Puentes-Bravo et al. | |
| 5,669,942 | A * | 9/1997 | McCullough | 51/307 |
| 6,291,421 | B1 | 9/2001 | Jacques et al. | |
| 6,436,889 | B1 * | 8/2002 | Sta et al. | 510/298 |
| 6,495,511 | B2 | 12/2002 | Kitching | |
| 6,881,717 | B1 | 4/2005 | Hall et al. | |
| 2002/0045559 | A1 * | 4/2002 | Forth et al. | 510/297 |
| 2004/0142841 | A1 * | 7/2004 | de Buzzaccarini et al. | 510/296 |
| 2007/0111919 | A1 * | 5/2007 | Boerefijn et al. | 510/445 |

FOREIGN PATENT DOCUMENTS

| | | | |
|---|---|---|---|
| GB | 2 138 037 | A | 10/1984 |
| JP | 49085102 | | 8/1974 |
| JP | 61-213298 | A | 9/1986 |
| JP | 3-137277 | A | 6/1991 |
| JP | 5-140869 | A | 6/1993 |
| JP | 8-506843 | A | 7/1996 |
| JP | 2002-249799 | A | 9/2002 |
| JP | 2002-541342 | A | 12/2002 |
| JP | 2003-531969 | A | 10/2003 |
| WO | WO-00/03959 | A1 | 1/2000 |

OTHER PUBLICATIONS

Shuchi Kanyo Gijutsu Shi (Laundry Powder Detergent), published of Mar. 26, 1998.
Office Action issued Dec. 28, 2010, in Chinese Patent Application No. 200680026969.X, with English translation.
Office Action issued Jun. 2, 2011, in corresponding Japanese Patent Application No. 2007-529245 (with English translation).

* cited by examiner

*Primary Examiner* — John Hardee
(74) *Attorney, Agent, or Firm* — Birch, Stewart, Kolasch & Birch, LLP

(57) ABSTRACT

[PROBLEMS] To provide a softening detergent composition capable of washing a fibrous manufactured article or the like having softening ability, and at the same time allowing a clay mineral to be less likely to remain on clothes.
[SOLVING MEANS] A softening detergent composition containing (a) 2 to 20% by mass of clay granules containing as a main component a smectite clay mineral represented by the following general formula (I), provided that a Na/Ca mass ratio in the granules is 1.0 or more: $[Si_8(Mg_aAl_b)O_{20}(OH)_4]^{X-}.X/n\ [Me]^{n+}$ (I), wherein a, b, and x satisfy the formulas $0<a\leqq 6$, $0\leqq b\leqq 4$, $0.2\leqq x=12-2a-3b\leqq 1.2$; Me is at least one member of Na, K, Li, Ca, Mg and $NH_4$; and n is valency of Me; (b) 3 to 9% by mass of a nonionic surfactant; and (c) 12 to 27% by mass of an anionic surfactant, provided that a salt of a fatty acid is excluded; and the softening detergent composition used for hand-washing.

1 Claim, No Drawings

SOFTENING DETERGENT COMPOSITION

TECHNICAL FIELD

The present invention relates to a softening detergent composition in which a clay mineral is used as a softening base agent.

BACKGROUND ART

Conventionally, there has been studied to blend a softening agent to a detergent for the purpose of preventing the loss of softness to have a stiff feel of the washed fibrous manufactured article due to the detachment of a fiber treating agent, deposition of salts or the like. For example, as a softening agent for giving softness to the feel of the fibrous manufactured article by the deposition of the softening agent on the fiber surface, a clay material such as smectite (see, for instance, Patent Publication 1); a cationic surfactant such as a dialkylated quaternary ammonium salt (see, for instance, Non-Patent Publication 1); a silicone such as poly(dimethyl siloxane) (see, for instance, Patent Publication 2); and the like have conventionally been known to be blended. Also, in recent years, studies have been made on a method of enhancing softening effects of a clay mineral from the viewpoint of easiness in formulation, environmental issue and the like. For instance, there have been known a combined use of bentonite and a pentaerythritol compound (see, for instance, Patent Publication 3), a combined use of a clay mineral and an aggregating agent (see, for instance, Patent Publication 4), a combined use of bentonite and a soluble potassium salt (see, for instance, Patent Publication 5, and Non-Patent Publication 1), and the like.

On the other hand, in recent years, as a part of reinforcement of detergency, especially detergency against oil stains, a nonionic surfactant has been formulated as a main surfactant. However, as a result of intensive studies, the present inventors have found a disadvantage that if a nonionic surfactant is present in a detergent containing a clay mineral, the dissolubility of the clay mineral itself is likely to be lowered, which causes the detergent to remain on clothes, thereby causing softening ability of the clothes to be lowered.

Patent Publication 1: JP-A-Showa-49-85102

Patent Publication 2: JP-A-2002-249799

Patent Publication 3: JP-A-Hei-5-140869

Patent Publication 4: JP-A-2002-541342

Patent Publication 5: JP-A-Hei-8-506843

Non-Patent Publication 1: Shuchi Kanyo Gijutsu Shu (Laundry Powder Detergent), published on Mar. 26, 1998

DISCLOSURE OF INVENTION

Problems to be Solved by the Invention

An object of the present invention is to provide a softening detergent composition capable of washing a fibrous manufactured article or the like having softening ability, and at the same time allowing a clay mineral to be less likely to remain on clothes by using the softening detergent composition.

Means to Solve the Problems

Specifically, the gist of the present invention relates to:

[1] a softening detergent composition containing:

(a) 2 to 20% by mass of clay granules containing as a main component a smectite clay mineral represented by the following general formula (I), provided that a Na/Ca mass ratio in the granules is 1.0 or more:

$$[Si_8(Mg_aAl_b)O_{20}(OH)_4]^{X-}.X/n\ [Me]^{n+} \quad (I)$$

wherein a, b, and x satisfy the formulas $0<a\leqq 6$, $0\leqq b\leqq 4$, $0.2\leqq x=12-2a-3b\leqq 1.2$; Me is at least one member of Na, K, Li, Ca, Mg and $NH_4$; and n is valency of Me;

(b) 3 to 9% by mass of a nonionic surfactant; and (c) 12 to 27% by mass of an anionic surfactant, provided that a salt of a fatty acid is excluded; and

[2] the softening detergent composition according to the item [1], used for hand-washing.

Effects of the Invention

By using the softening detergent composition of the present invention, there are exhibited some effects that a fibrous manufactured article or the like having softening ability can be washed, and that a clay mineral is less likely to remain on clothes.

BEST MODE FOR CARRYING OUT THE INVENTION

1. Softening Detergent Composition

The softening detergent composition of the present invention will be described more specifically hereinbelow.

<Component (a)>

The component (a) of the present invention is clay granules containing a smectite clay mineral represented by the following general formula (I) as a main component (In the present application, the main component refers to those contained in an amount of 50% by mass or more in the granules), provided that a Na/Ca mass ratio in the granules is 1.0 or more:

$$[Si_8(Mg_aAl_b)O_{20}(OH)_4]^{X-}.X/n\ [Me]^{n+} \quad (I)$$

wherein a, b, and x satisfy the formulas $0<a\leqq 6$, $0\leqq b\leqq 4$, $0.2\leqq x=12-2a-3b\leqq 1.2$; Me is at least one member of Na, K, Li, Ca, Mg and $NH_4$; and n is valency of Me.

The component (a) is contained in an amount of from 2 to 20% by mass, preferably from 4 to 18% by mass, more preferably from 6 to 16% by mass, even more preferably from 8 to 15% by mass, and especially preferably from 10 to 14% by mass, of the softening detergent composition, from the viewpoint of softening ability and detergency.

Since a clay mineral, especially a natural product, contains impurities such as quartz, cristobalite—, calcite, and feldspar, the amount of the component (a) contained refers to those including these impurities. In addition, components such as water, a binder, an additive, or the like, used during the granulation is also included in the amount of the component (a) contained.

The main component as used herein means that the clay mineral represented by the general formula (I) is contained in an amount of 50% by mass or more, and a total amount of the clay mineral represented by (I) and quartz, cristobalite and water, which are present as ordinary impurities for the clay mineral, is preferably 90% by mass or more, and more preferably 92% by mass or more, of the clay granules.

In addition, a Na/Ca mass ratio of the granules is 1.0 or more, preferably 1.5 or more, and more preferably 2.0 or more, from the viewpoint of property of generating insoluble remnants on clothes. A Na/Ca mass ratio is preferably 5.0 or less, and more preferably 4.0 or less, from the viewpoint of softening ability.

As a method for obtaining clay granules having a high Na/Ca mass ratio, if the clay granules are a natural product, their origin may be selected. Alternatively, for example, when clay granules are being produced, the mass ratio can also be adjusted by adding a Na salt or the like. In addition, if the clay granules are a synthetic product, the mass ratio can be arbitrarily adjusted by a known method.

As a method for producing clay granules having a high Na/Ca mass ratio, the following method is useful. The method is a method including the step of adding a Na salt such as sodium carbonate, which is in the form of powder, to a raw material clay ore, and thereafter drying the mixture; or a method including the step of adding a Na salt such as sodium carbonate, which is in the form of powder or an aqueous solution upon granulating a clay ore previously pulverized into a powdery state with a granulator.

The Na/Ca mass ratio of the clay granules is determined by the following method.

A 0.1 g sample prepared by pulverizing clay granules with a mortar and pestle, and allowing the pulverized product to pass through a sieve having a sieve opening of 125 μm was subjected to sulfuric acid-hydrogen peroxide degradation with a microwave wet-type ashing apparatus (automatic). A measuring flask in which the degradation product was placed was filled to the brim to a volume of 50 mL, and determined with an ICP emission analyzing apparatus to quantify the amounts of Na and Ca. The mass ratio is calculated from the found values.

The clay granules have a bulk density of preferably from 500 to 1200 g/L, more preferably from 600 to 1100 g/L, and especially preferably from 700 to 1050 g/L, from the viewpoint of non-classifiable property. The clay granules have an average particle size of preferably from 200 to 1000 μm, more preferably from 300 to 900 μm, and especially preferably from 400 to 800 μm, from the viewpoint of low-dust generating property and non-classifiable property.

In addition, clay granules containing the group of granules having sizes of from 180 to 1410 μm in an amount of 90% by mass or more of the entire granules, from the viewpoint of dust generating property and appearance are preferable, and clay granules containing the group of granules having sizes of from 180 to 1410 μm in an amount of 95% by mass or more are more preferable.

The clay granules have a water content of preferably 18% by mass or less, more preferably 16% by mass or less, and even more preferably 14% by mass or less, from the viewpoint of granule strength.

The aqueous solution of the clay granules has a pH of preferably 9.0 or more, more preferably 9.5 or more, and even more preferably 10.0 or more, under the determination conditions of 20° C. and 2% by mass, from the viewpoint of the quality control.

[Average Particle Size]

The average particle size is obtained from the weight percentages according to the sizes of each of the standard sieves as prescribed in JIS K 8801 after vibrating the sieves for five minutes.

[Bulk Density]

The bulk density is determined by the method defined in JIS K 3362.

[Non-Classifiable Property]

One gram of colored clay granules and 100 g of detergent granules (average particle size: 350 μm and bulk density: 820 g/L) are blended, and thereafter vibration was applied to the blended mixture with a mixer. Whether or not classification takes place is judged visually.

<Component (b)>

As the component (b), a nonionic surfactant is contained in an amount of from 3 to 9% by mass. The component (b) is contained in an amount of preferably from 4 to 9% by mass, and more preferably from 4 to 8% by mass, of the softening detergent composition, from the viewpoint of softening ability, detergency and the property of generating insoluble remnants on clothes.

The component (b) includes polyoxyalkylene alkyl(8 to 20 carbon atoms) ethers, alkyl polyglycosides, polyoxyalkylene alkyl(8 to 20 carbon atoms) phenyl ethers, polyoxyalkylene sorbitan fatty acid(8 to 22 carbon atoms) esters, polyoxyalkylene glycol fatty acid(8 to 22 carbon atoms) esters, polyoxyethylene-polyoxypropylene block polymers, and the like. Especially, a polyoxyalkylene alkyl ether in which an alkylene oxide such as ethylene oxide or propylene oxide is added to an alcohol having 10 to 18 carbon atoms is preferable. The average number of moles of the alkylene oxide added is preferably from 4 to 20, more preferably from 4 to 16, even more preferably from 4 to 12, and especially preferably from 4 to 8, from the viewpoint of improving softening ability. The nonionic surfactant has an HLB value of preferably from 10.5 to 15.0, more preferably from 11.0 to 14.5, as calculated by Griffin method.

<Component (c)>

As the component (c), an anionic surfactant, provided that a salt of a fatty acid is excluded, is contained in an amount of from 12 to 27% by mass, from the viewpoint of detergency and softening ability. The component (c) is contained in an amount of preferably from 12 to 25% by mass, more preferably 16 to 25% by mass, and even more preferably from 20 to 25% by mass, of the softening detergent composition, from the viewpoint of softening ability and detergency.

The component (c) includes salts of sulfuric acid esters of alcohols having 10 to 18 carbon atoms, salts of sulfuric acid esters of alkoxylates of alcohols having 8 to 20 carbon atoms, alkylbenzenesulfonates, paraffinsulfonates, α-olefinsulfonates, salts of α-sulfofatty acids, salts of alkyl esters of α-sulfofatty acids, and the like. In the present invention, especially, those containing linear alkylbenzenesulfonates of which alkyl moiety has 10 to 14 carbon atoms, more preferably 12 to 14 carbon atoms, or alkyl sulfates of which alkyl moiety has 10 to 18 carbon atoms are preferable. As the counterions, alkali metal salts and amines are preferable, and especially sodium and/or potassium, monoethanolamine and diethanolamine are preferable.

In addition, a mixture system with an alkyl sulfate is more preferable, and those having a mass ratio of alkylbenzenesulfonate/alkyl sulfate of from 30/1 to 1/1 are even more preferable, and those having a mass ratio of from 5/1 to 6/5 are especially preferable. Further, a branched to linear alkyl moiety of the alkyl sulfate is from 10/90 to 99/1, more preferably from 20/80 to 97/3, even more preferably from 30/70 to 95/5, and especially preferably from 40/60 to 90/10, from the viewpoint of softening ability.

<Component (d)>

It is preferable that the softening detergent composition of the present invention further contains an alkalizing agent as a component (d) in an amount of from 10 to 25% by mass. The component (d) includes (d1) carbonates, (d2) crystalline silicates, (d3) amorphous silicates, and the like. The softening detergent composition contains a component (d1) in an amount of preferably from 12 to 24% by mass, from the viewpoint of detergency, and contains a component (d2) in an amount of preferably from 0.5 to 3% by mass, and more preferably from 0.5 to 2% by mass, from the viewpoint of softening ability, and contains a component (d3) in an amount of preferably 5% by mass or less, from the viewpoint of detergency and softening ability.

<Component (e)>

In addition, the softening detergent composition of the present invention further contains a salt of a fatty acid as a component (e) in an amount of preferably from 0.3 to 3% by mass, more preferably from 0.4 to 2% by mass, and even more preferably from 0.5 5o 1.5% by mass, from the viewpoint of softening ability.

The salt of a fatty acid includes, for example, fatty acids having 10 to 22 carbon atoms, and the like, and those having 10 to 18 carbon atoms are preferable. The counterion is preferably an alkali metal ion such as sodium or potassium ion, and especially a sodium ion is preferable.

<Component (f)>

In addition, the softening detergent composition of the present invention further contains a polyhydric alcohol as a component (f) in an amount of preferably from 0.1 to 10% by mass, more preferably from 0.2 to 6% by mass, even more preferably from 0.4 to 4% by mass, and especially preferably from 0.6 to 3% by mass, from the viewpoint of softening ability and dissolubility.

As the component (f), a compound having two or more hydroxyl groups in its molecule is preferable. In addition, the polyhydric alcohol of the component (f) has a melting point of preferably 40° C. or lower, more preferably 30° C. or lower, and even more preferably 20° C. or lower. Here, this melting point can be determined in accordance with a method by visual examination of "Determination Methods of Melting Point and Melting Range of Chemical Manufactured Article" of JIS K0064-1992.

As the component (f), glycerol and/or a polyethylene glycol is preferable.

<Water>

In addition, the softening detergent composition contains water (water content in accordance with method of mass loss by heating as prescribed in JIS K 3362:1998) in an amount of preferably from 0.1 to 10% by mass, more preferably from 0.2 to 6% by mass, and even more preferably from 0.5 to 4% by mass, from the viewpoint of stability and productivity.

<Other Components>

The softening detergent composition of the present invention can contain a builder (amorphous aluminosilicate, sodium tripolyphosphate, sodium pyrophosphate, organic builder such as aminocarboxylate, hydroxyaminocarboxylate, hydroxycarboxylate, cyclocarboxylate, ether carboxylate, or organic carboxylic acid (carboxylate) polymer, or the like); agent for preventing redeposition (polyacrylate, carboxymethyl cellulose, or the like); other softening agent; a fluorescer; a defoaming agent (soap, silicone, or the like); an enzyme (protease, cellulase, amylase, lipase, and the like); enzyme stabilizer; colorant; perfume or the like, which is known in the field of laundry detergents.

The softening detergent composition of the present invention having the components as described above can be produced by mixing each of the above-mentioned components by a known method. Also, the softening detergent composition may be subjected to surface modification with a surface-modifying agent, from the viewpoint of free-flowability and anti-caking property.

2. Physical Properties of Softening Detergent Composition

The softening detergent composition of the present invention is preferably in the form of powder or tablet, from the viewpoint of stability, and more preferably in the form of powder. The softening detergent composition has an average particle size of preferably from 200 to 1000 μm, more preferably from 250 to 900 μm, even more preferably from 300 to 800 μm, as determined from the particle size determined by a sieving method with a sieving machine as prescribed in JIS K 3362:1998, from the viewpoint of low-temperature dissolubility and stability. The softening detergent composition has a bulk density of preferably from 300 to 1200 g/L, more preferably from 400 to 1100 g/L, even more preferably from 600 to 1000 g/L, especially preferably from 700 to 980 g/L, as determined by the method as prescribed in JIS K 3362:1998, from the viewpoint of low-temperature dissolubility and stability.

A 0.1% by mass aqueous solution of the softening detergent composition has a pH of preferably from 8 to 12, more preferably from 9 to 11.5, even more preferably from 9.5 to 11, and especially preferably from 10 to 11, as determined by the method prescribed in JIS K3362:1998 at 20° C., from the viewpoint of detergency, softening ability, and damaging property.

The softening detergent composition has a calcium capturing capacity of preferably from 20 to 300 $CaCO_3$ mg/g, more preferably from 50 to 200 $CaCO_3$ mg/g, even more preferably from 100 to 150 $CaCO_3$ mg/g, as determined by the following determination method, from the viewpoint of detergency and softening ability.

(Method for Determination of Calcium Capturing Capacity)

The calcium capturing capacity (amount of calcium ions captured) is obtained in accordance with the method described in JP-A-Hei 3-277696, page 3, lower right column, line 6 to page 4, upper left column, line 6 (provided that the anionic surfactant should read as a softening detergent composition).

The above-mentioned softening detergent composition of the present invention can be used, for machine-washing and hand-washing. The method for machine-washing or hand-washing is not particularly limited, and the method is carried out by a known method, and fibrous manufactured articles and the like can be washed.

EXAMPLES

Examples 1 to 5 and Comparative Examples 1 to 4

A detergent base was obtained from components excluding a clay mineral, enzymes, a perfume, and 3% by mass of a zeolite for surface modification. To the detergent base were added and mixed the remaining components, to give a softening detergent composition. The components of the softening detergent composition are shown in Table 1.

All of the obtained softening detergent compositions had a pH of their 0.1% by mass aqueous solutions in the range of from 10 to 11, as determined by the method as prescribed in JIS K3362:1998 at 20° C., an amount of calcium ions captured in the range of from 50 to 200 $CaCO_3$ mg/g, an average particle size in the range of from 300 to 800 μm, and a bulk density in the range of from 700 to 980 g/L.

TABLE 1

| | | Composition No. | | | | | | | | |
|---|---|---|---|---|---|---|---|---|---|---|
| | | 1 Ex. | 2 Ex. | 3 Ex. | 4 Ex. | 5 Ex. | 1 Comp. Ex. | 2 Comp. Ex. | 3 Comp. Ex. | 4 Comp. Ex. |
| Formulation Composition of Softening Detergent Composition (% by mass) | | | | | | | | | | |
| (a) | Clay Granules (I) | 13 | 13 | | | | | | | 13 |
| | Clay Granules (II) | | | 13 | | | | | | |
| | Clay Granules (III) | | | | 13 | | | | | |
| | Clay Granules (IV) | | | | | | 13 | | | |
| | Clay Granules (V) | | | | | | | 13 | | |
| | Clay Granules (VI) | | | | | | | | 13 | |
| | Clay Granules (VII) | | | | | 13 | | | | |
| (b) | Nonionic Surfactant | 6 | 4 | 6 | 6 | 6 | 6 | 6 | 6 | 22 |
| (c) | Anionic Surfactant | 14 | 20 | 14 | 14 | 14 | 14 | 14 | 14 | 7 |
| (d) | Sodium Carbonate | 20 | 20 | 20 | 20 | 20 | 20 | 20 | 20 | 20 |
| | Crystalline Silicate | 1 | 1 | 1 | 1 | 1 | 1 | 1 | 1 | 1 |
| (e) | Soap | 1 | 1 | 1 | 1 | 1 | 1 | 1 | 1 | 1 |
| (f) | PEG | 0.8 | 0.8 | 0.8 | 0.8 | 0.8 | 0.8 | 0.8 | 0.8 | 0.8 |
| Zeolite | | 23 | 22 | 23 | 23 | 23 | 23 | 23 | 23 | 20 |
| Sodium Sulfate | | 14 | 11 | 14 | 14 | 14 | 14 | 14 | 14 | 11 |
| Oligomer D | | 5 | 5 | 5 | 5 | 5 | 5 | 5 | 5 | 5 |
| Enzymes | | 0.4 | 0.4 | 0.4 | 0.4 | 0.4 | 0.4 | 0.4 | 0.4 | 0.4 |
| Perfume | | 0.3 | 0.3 | 0.3 | 0.3 | 0.3 | 0.3 | 0.3 | 0.3 | 0.3 |
| Water | | 1.5 | 1.5 | 1.5 | 1.5 | 1.5 | 1.5 | 1.5 | 1.5 | 1.5 |
| Physical Properties | | | | | | | | | | |
| Na/Ca Mass Ratio of Bentonite | | 2.5 | 2.5 | 1.5 | 1.2 | 2.5 | 0.7 | 0.5 | 0.04 | 2.5 |
| Evaluation | | | | | | | | | | |
| Detergency | | ○ | ○ | ○ | ○ | ○ | ○ | ○ | ○ | ○ |
| Softening Ability | | ○ | ◎ | ○ | ○ | ○ | ○ | ○ | ○ | X |
| Property of Generating Insoluble Remnants on Clothes | | ◎ | ◎ | ○ | ○ | ◎ | Δ | Δ | X | X |

The detergency, the softening ability, and the property of generating insoluble remnants on clothes of the resulting softening detergent compositions were evaluated in accordance with the following methods. The results are shown in Table 1.

(Preparation of Cloths with Sebum Dirt Stains on Collar)

The cloths with sebum dirt stains on collar as prescribed in JIS K3362:1998 were prepared.

(Washing Conditions and Evaluation Method)

The detergency of the softening detergent compositions of Table 1 was compared to that of the detergency-judging index detergent in accordance with the method for evaluating detergency for laundry synthetic detergents as prescribed in JIS K 3362:1998. Here, the used concentration of the softening detergent composition of Table 1 was 1.0 g/L.

Evaluation Criteria ○: The detergency is higher than that of the index detergent.

Δ: The detergency is of the same level as that of the index detergent.

X: The detergency is lower than that of the index detergent.

(Preparation of Towel for Evaluation)

A commercially available cotton towel (cotton 100%) was treated with a 0.5 g/L solution of a pretreatment agent mixture prepared by mixing a nonionic surfactant (ethylene oxide adduct prepared by adding ethylene oxide in an average of 6 mol to a primary alcohol having 12 carbon atoms), a crystalline silicate ("Prefeed Granules") and sodium carbonate in a weight ratio of 1:1:3 using a mini-wash machine ("N-BK2" commercially available from National Panasonic). At a water temperature of 20° C., a cycle of washing for 7 minutes, a centrifugal spin-drying, a 3-minute rinsing, spin-drying, a 3-minute rinsing and spin-drying was repeated for a total of five times, and the treatment agent mixture was removed therefrom.

(Evaluation Method for Softening Ability (Conditions for Machine-Washing)

5.0 g of a softening detergent composition of Table 1 and 0.3 kg of cotton towels (4 pieces of 70 cm×30 cm) were introduced into 5 L of water at 20° C., and the towels were washed for 7 minutes. After spin-drying, the towels were subjected to a 3-minute rinsing in 5 L of water, spin-drying, a 3-minute rinsing, spin-drying, and air-drying.

Sensory evaluation of the feel of softness was conducted by the five individuals using the towel washed with the softening detergent composition and the pre-treated towel as a pair for the evaluation. The case where there is no difference or where the washed towel is hardened had a score 0; the case where the washed towel is slightly softened had a score 1; the case where the washed towel is softened to some extent had a score 2; and the case where the washed towel is clearly softened had a score 3. The softening ability for a total score of five individuals was evaluated as follows. Here, those evaluated as ○ or higher were considered to be acceptable products.

Evaluation Criteria:

◎: The total score is score 10 or higher.

○: The total score is score 6 or higher and less than score 10.

Δ: The total score is score 3 or higher and less than score 6.

X: The total score is less than score 3.

(Evaluation Method for Property of Generating Insoluble Remnants on Clothes)

5.0 g of a softening detergent composition of Table 1 and 0.3 kg of black, single cotton broadcloth 40 (19 pieces of cloths worked to a size of 30 cm×38 cm) (manufactured by K.K. Tanigashira Shoten) were introduced into 5 L of water at 5° C., and the towels were washed for 7 minutes. After spin-drying, the towels were subjected to a 3-minute rinsing in 5 L of water, spin-drying, a 3-minute rinsing, spin-drying, and air-drying.

The property of generating insoluble remnants on clothes was evaluated, in accordance with the following evaluation criteria, from the number and the sizes of the insoluble remnants on front and back side per piece of the black cotton broadcloth washed with the softening detergent composition.

Evaluation Criteria:

◎: The insoluble remnants are not found (hardly found).

○: There are no insoluble remnants of granules having larger sizes (0.5 mm or more), and a dozen or so granules of insoluble remnants of fine powder (0.5 mm or less) are found.

Δ: There are no insoluble remnants of granules having larger sizes (0.5 mm or more), and several dozen granules of insoluble remnants of fine powder (0.5 mm or less) are found.

X: There are some insoluble remnants of granules having larger sizes (0.5 mm or more), and insoluble remnants of fine powder (0.5 mm or less) are also found.

XX: There are at least several insoluble remnants of granules having larger sizes (0.5 mm or more), and a large number of insoluble remnants of fine powder (0.5 mm or less) are also found.

Here, the evaluations on the detergency, the softening ability, and the property of generating insoluble remnants on clothes using the softening detergent composition used for hand-washing, even under the following hand-washing conditions, showed similar evaluation results to the evaluation results for machine-washing conditions shown in Table 1.

(Evaluation Method for Softening Ability [Hand-Washing Conditions])

A 8.2 L polypropylene washtub (manufactured by YAZAKI) having a diameter of 30 cm and a depth of 13 cm was charged with 2 liters of hard water (Ca/Mg=7/3 (molar ratio)) corresponding to 8.9 mg $CaCO_3$/liter, temperature-controlled to 25° C., and 15 g of a softening detergent composition listed in Table 1 was supplied into the water, and thereafter the water was continued to be stirred by hand so as not to spill water from the washtub. After 30 seconds from the beginning of stirring, 0.3 kg of cotton towels (4 pieces having sizes of 70 cm×30 cm) were introduced, and hand-washed for 5 minutes. After sufficiently squeezing the towels, the towels were subjected to a 3-minute rinsing with 5 L of water, squeezing, a 3-minute rinsing, squeezing, and air-drying.

It can be seen from the results of Table 1 that since the components (a), (b), and (c) are formulated in given concentrations and given ratios in Examples 1 to 5, softening detergent compositions having excellent property of generating insoluble remnants on clothes, softening ability, and detergency are obtained.

In Examples, as each component, the following ones were used.

Zeolite: "Zeobuilder" (manufactured by Zeobuilder, median diameter: 3.0 μm);

Anionic Surfactant: a sodium linear alkylbenzenesulfonate of which alkyl moiety has 12 to 14 carbon atoms;

Nonionic Surfactant: an adduct prepared by adding ethylene oxide in an average of 6 mol to a primary alcohol having 10 to 14 carbon atoms;

PEG: polyethylene glycol (weight-average molecular weight: 10000);

Crystalline Silicate: "Prefeed granules" (manufactured by K. K. Tokuyama Siltex);

Oligomer D: Polyacrylic acid (average molecular weight: 15,000, as determined by GPC, calculated as polyethylene glycol);

Enzymes: "Cellulase K" (disclosed in JP-A-Showa 63-264699), "Kannase 24TK" (manufactured by Novozymes), and "Savinase 6.0T" (manufactured by Novozymes) being used in a mass ratio of 3:1:2;

As Clay Granules (I) to (VII) in Examples, the followings ones are used.

The method for producing clay granules are as follows.

One-hundred parts by mass of a bentonite clay ore having a Na/Ca mass ratio of 0.6 and a water content of 25% and 3.55 parts by mass of sodium carbonate are supplied into a 2 L Henschel mixer, and the ingredients are mixed at a rotational speed of 1600 rpm for 3 minutes. The resulting mixture is granulated with an extruder-granulator (screen diameter: 2 mmϕ). Next, the resulting granules are dried with a dryer at 80° C. until the water content is reduced to 8%, and the dried granules are pulverized with a mortar and pestle to a size of 125 μm-sieve-pass. One-hundred parts by mass of this pulverized product are supplied into the Henschel mixer, and 25 parts by mass of water are added thereto while mixing at a rotational speed of 1600 rpm, and the mixture is blended for 30 seconds. This mixture is dried with a dryer at 80° C. until the water content is reduced to 12.5%, and those pulverized products that are oversized (1410 μm or more) and those that are undersized (180 μm or less) are excluded, to give Clay Granules (I). The resulting clay granules have a Na/Ca mass ratio of 2.5.

The method for producing Clay Granules (II) is carried out in accordance with the method for producing Clay Granules (I), except that the amount of sodium carbonate supplied is changed to 1.55 parts by mass. The resulting clay granules have a water content of 12.6%, and a Na/Ca mass ratio of 1.5.

The method for producing Clay Granules (III) is carried out in accordance with the method for producing Clay Granules (I), except that the amount of sodium carbonate supplied is changed to 0.98 parts by mass. The resulting clay granules have a water content of 12.5%, and a Na/Ca mass ratio of 1.2.

The method for producing Clay Granules (IV) is carried out in accordance with the method for producing Clay Granules (I), except that the amount of sodium carbonate supplied is changed to 0.027 parts by mass. The resulting clay granules have a water content of 12.8%, and a Na/Ca mass ratio of 0.7.

The method for producing Clay Granules (V) are as follows.

One-hundred parts by mass of a bentonite clay ore having a Na/Ca mass ratio of 0.04 and a water content of 25% and 0.87 parts by mass of sodium carbonate are supplied into a 2 L Henschel mixer, and the ingredients are mixed at a rotational speed of 1600 rpm for 3 minutes. The resulting mixture is granulated with an extruder-granulator (screen diameter: 2 mmϕ). Next, the resulting granules are dried with a dryer at 80° C. until the water content is reduced to 8%, and the dried granules are pulverized with a mortar and pestle to a size of 125 μm-sieve-pass. One-hundred parts by mass of this pulverized product are supplied into the Henschel mixer, and 25 parts by mass of water are added thereto while mixing at a rotational speed of 1600 rpm, and the mixture is blended for 30 seconds. This mixture is dried with a dryer at 80° C. until the water content is reduced to 12.3%, and those pulverized products that are oversized (1410 μm or more) and those that are undersized (180 μm or less) are excluded, to give Clay Granules (V). The resulting clay granules have a Na/Ca mass ratio of 0.5.

The method for producing Clay Granules (VI) are as follows.

A bentonite clay ore having a Na/Ca mass ratio of 0.04 and a water content of 25% is dried with a dryer at 80° C. until the water content is reduced to 8%, and the dried granules are pulverized with a mortar and pestle to a size of 125 μm-sieve-pass. This pulverized product is supplied into the Henschel mixer, and 25 parts by mass of water are added thereto while mixing at a rotational speed of 1600 rpm, and the mixture is blended for 30 seconds. This mixture is dried with a dryer at 80° C. until the water content is reduced to 12.2%, and those pulverized products that are oversized (1410 μm or more) and those that are undersized (180 μm or less) are excluded to give Clay Granules (VI). The resulting clay granules have a Na/Ca mass ratio of 0.04.

The method for producing Clay Granules (VII) are as follows.

A bentonite clay ore having a Na/Ca mass ratio of 0.6 and a water content of 25% is dried with a dryer at 80° C. until the water content is reduced to 8%, and the dried granules are pulverized with a mortar and pestle to a size of 125 μm-sieve-pass. In addition, sodium carbonate is pulverized in the same manner with a mortar and pestle to a size of 125 μm-sieve-pass. 3.55 parts by mass of the sodium carbonate pulverized product and 100 parts by mass of the bentonite pulverized product are supplied into a Henschel mixer, and 25 parts by mass of water are added thereto while mixing at a rotational speed of 1600 rpm, and the mixture is blended for 30 seconds. This mixture is dried with a dryer at 80° C. until the water content is reduced to 12.7%, and those pulverized products that are oversized (1410 μm or more) and those that are undersized (180 μm or less) are excluded to give Clay Granules (VII). The resulting clay granules have a Na/Ca mass ratio of 2.5.

INDUSTRIAL APPLICABILITY

The softening detergent composition of the present invention can be suitably used in a softening detergent for fibrous manufactured articles, such as clothes, as represented by, for example, towels, bath towels, T-shirts, and sweat shirts, each made of cotton.

The invention claimed is:

1. A method of washing a fibrous manufactured article, comprising adding a softening detergent composition in the form of a powder and the fibrous manufactured article either separately or in combination to water; said softening detergent composition comprising:

(a) 2 to 20% by mass of clay granules comprising as a main component a smectite clay mineral represented by the following general formula (I), provided that a Na/Ca mass ratio in the granules is 2.0 to 4.0:

$$[Si_8(Mg_aAl_b)O_{20}(OH)_4]^{X-}.X/n[Me]^{n+} \quad (I)$$

wherein a, b, and x satisfy the formulas $0<a\leqq 6$, $0\leqq b\leqq 4$, $0.2\leqq x=12-2a-3b\leqq 1.2$; Me is at least one member of Na, K, Li, Ca, Mg and $NH_4$; and n is valency of Me;

(b) 3 to 9% by mass of a nonionic surfactant; and (c) 12 to 27% by mass of an anionic surfactant, provided that a salt of a fatty acid is excluded as a part of anionic surfactant (c);

wherein the average particle size of the (a) clay granules is 300 to 1000 μm.

* * * * *